US012458074B1

(12) United States Patent
Britt

(10) Patent No.: US 12,458,074 B1
(45) Date of Patent: Nov. 4, 2025

(54) ACTIVE ENHANCEMENT APPAREL

(71) Applicant: Abigail Marie Britt, Nunica, MI (US)

(72) Inventor: Abigail Marie Britt, Nunica, MI (US)

( * ) Notice: Subject to any disclaimer, the term of this patent is extended or adjusted under 35 U.S.C. 154(b) by 0 days.

(21) Appl. No.: 18/204,913

(22) Filed: Jun. 1, 2023

(51) Int. Cl.
*A41B 1/08* (2006.01)

(52) U.S. Cl.
CPC ..... *A41B 1/08* (2013.01); *A41B 2400/38* (2013.01); *A41B 2500/50* (2013.01)

(58) Field of Classification Search
CPC ..... A41D 2400/82; A41D 13/0002
See application file for complete search history.

(56) References Cited

U.S. PATENT DOCUMENTS

| | | | | |
|---|---|---|---|---|
| 5,148,002 | A | 9/1992 | Kuo et al. | |
| D517,282 | S | 3/2006 | Tanner et al. | |
| D539,512 | S | 4/2007 | Ota et al. | |
| D575,930 | S | 9/2008 | Vacchiano | |
| 8,910,317 | B2 | 12/2014 | Decker | |
| 8,948,839 | B1 | 2/2015 | Longinotti-Buitoni et al. | |
| D726,995 | S | 4/2015 | Garabedian et al. | |
| D733,397 | S | 7/2015 | Harps | |
| D733,994 | S | 7/2015 | Hays et al. | |
| 9,439,459 | B2 | 9/2016 | Plancanica et al. | |
| D874,157 | S | 2/2020 | Tutor | |
| D912,368 | S | 3/2021 | Wright | |
| 2009/0171259 | A1 | 7/2009 | Soerensen et al. | |
| 2010/0256717 | A1* | 10/2010 | Brown | A41D 31/185 607/115 |
| 2011/0209267 | A1* | 9/2011 | Rush | A41D 7/005 2/228 |
| 2011/0302686 | A1 | 12/2011 | Chapuis | |
| 2012/0179080 | A1 | 7/2012 | Sakamoto et al. | |
| 2012/0311760 | A1 | 12/2012 | Puni | |
| 2013/0326785 | A1* | 12/2013 | Cornacchiari | A41D 1/00 2/69 |
| 2014/0196190 | A1* | 7/2014 | Brown | A41C 3/0057 2/69 |
| 2015/0082510 | A1 | 3/2015 | Inzer | |
| 2019/0142081 | A1* | 5/2019 | Kingsbury | A41D 1/08 2/69 |
| 2019/0142087 | A1* | 5/2019 | Kelly | C08L 1/02 2/170 |
| 2019/0254852 | A1* | 8/2019 | Ryndziewicz | A61F 5/0104 |
| 2021/0298369 | A1* | 9/2021 | Polstein | A41B 9/12 |
| 2022/0241100 | A1* | 8/2022 | Eom | A61F 13/08 |
| 2023/0127710 | A1* | 4/2023 | Yao | A41D 31/145 428/196 |

* cited by examiner

*Primary Examiner* — Patrick J. Lynch
(74) *Attorney, Agent, or Firm* — King & Partners, PLC

(57) ABSTRACT

An article of clothing adapted to be worn by a wearer, including: a shirt body, wherein the shirt body includes an inner surface and an outer surface, wherein the shirt body includes apertures for the wearer's head, arms, and torso, and wherein the shirt body is adapted to compressively fit the wearer in a non-restrictive manner, and a tactile cueing member, wherein the tactile cueing member is associated with the inner surface of the shirt body, and wherein the tactile cueing member contacts a portion of the wearer's skin during normal use.

1 Claim, 8 Drawing Sheets

ACTIVE ENHANCEMENT APPAREL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to apparel (e.g., shirts, shorts, pants, skorts, etcetera) and, more particularly, to active enhancement apparel that uses tactile cueing to remind the wearer to engage/tighten certain muscles, including, but not limited to, those in the abdomen, scapular, and lumbar regions and/or improve posture. The active enhancement apparel of the present invention achieves beneficial results without the use of braces and/or otherwise physically restricting movement of the wearer. The active enhancement apparel of the present invention also provides the wearer with tactile cueing even in the absence of a personal trainer and/or physical therapist.

2. Background Art

Modified apparel, shapewear, and braces have been known in the art for years and are the subject of a plurality of patents and publications, including: U.S. Pat. No. 9,439,459 entitled "Athletic Shirt," U.S. Pat. No. 8,948,839 entitled "Compression Garments Having Stretchable and Conductive Ink," U.S. Pat. No. 8,910,317 entitled "Shirts and Shorts Having Elastic and Non-Stretch Portions and Bands to Provide Hip and Posture Support," U.S. Pat. No. 5,148,002 entitled "Multi-Functional Garment System," United States Patent Application Publication Number 2015/0082510 entitled "Support Shirt," United States Patent Application Publication Number 2013/0326785 entitled "Garment for the Neuro-Musculo-Skeletal Assistance," United States Patent Application Publication Number 2012/0311760 entitled "Shoulder Stabilization Shirt," United States Patent Application Publication Number 2012/0179080 entitled "Posture-Improving Support Garment," United States Patent Application Publication Number 2011/0302686 entitled "Close-Fitting Sports Garment," and United States Patent Application Publication Number 2009/0171259 entitled "Abdominal Compression"—all of which are hereby incorporated herein by reference in their entirety including all references cited therein.

U.S. Pat. No. 9,439,459 appears to disclose an athletic shirt that includes at least one chest portion adapted to dress the user chest. The chest portion has a front face dressing the user torso and a rear face, opposite to the front face, which dresses the back of the user. The front face of the chest portion has an upper portion which covers the pectoral muscles of the user and a lower portion which covers the user's abdomen. The chest portion comprises adherence means for adhering the upper portion to the pectoral muscles of the user so that to limit or completely avoid the rubbing of the upper portion itself against the user's nipples. The adherence means includes an elastic portion.

U.S. Pat. No. 8,948,839 appears to disclose garments having one or more stretchable conductive ink patterns thereon. Described are garments, including compression garments, having one or more highly stretchable conductive ink pattern formed of a composite of an insulative adhesive, a conductive ink, and an intermediate gradient zone between the adhesive and conductive ink. The conductive ink typically includes between about 40-60% conductive particles, between about 30-50% binder; between about 3-7% solvent; and between about 3-7% thickener. The stretchable conductive ink patterns may be stretched more than twice their length without breaking or rupturing.

U.S. Pat. No. 8,910,317 appears to disclose an apparatus for garments that restrict detrimental or abnormal movement of the upper and lower body. This is made possible by forming garments from an elastic base layer and then coupling one or more elastic and/or inelastic bands coupled to, secured to, or atop the base material in locations that restrict detrimental movement of the body. A load distribution ring can anchor some of the bands.

U.S. Pat. No. 5,148,002 appears to disclose a multi-functional garment system that includes an outer shell garment, detachable inflatable insulation module, detachable heating module, detachable physiological parameter sensors, detachable communication module and detachable control and display module, the control module including environmental parameter sensors. Modularity of these various functional units allows a user to configure the garment system as needed for various activities. The control module provides for storing parameter limits and responses to fault conditions which occur when a parameter exceeds the corresponding limit. Stored responses to fault conditions include controlling any of the functional modules thereby providing improved convenience, comfort, and safety.

United States Patent Application Publication Number 2015/0082510 appears to disclose a support shirt that provides sleeve reinforcement regions on sleeve portions about a centerline. The centerline exists as a curvilinear axis across the support shirt. The support shirt comprises a shirt body, and shirt body sleeves positioned near the upper shirt body. The shirt body provides support for the wearer around the chest region. Sleeve portions are attached to the shirt body at the sleeve body holes. In an embodiment, the sleeve reinforcement regions comprise a length of taut material extending from the sleeve holes to an outer portion of the sleeve about the centerline. The sleeve portions extend in an outward direction relative to a frontal plane of the shirt body and in a downward direction relative to a transverse plane of the shirt body.

United States Patent Application Publication Number 2013/0326785 appears to disclose a garment for neuro-musculo-skeletal assistance that comprises a body of the garment provided with elasticity and intended to be worn by a user to adhere to a portion of the user's body and an elastic and continuous framework on the body of the garment and comprising a plurality of anchoring portions and a plurality of active portions, each intended to coincide with respective sectors of the user's body, where the framework is structured so that, when the garment is worn by the user and the latter carries out a motor activity, the active portions deform themselves following the deformation of the respective sectors of the user's body and the anchoring portions remain substantially unchanged.

United States Patent Application Publication Number 2012/0311760 appears to disclose an upper-body stabilization garment that includes a front portion to contact a front upper-body region of a subject, and a rear portion to contact a rear upper-body region of the subject. A first plurality of elastomeric strips extending diagonally relative to each other across the front portion, and a second plurality of elastomeric strips extending diagonally relative to each other across the rear portion. Each group may extend diagonally at an angle of approximately 15 degrees to approximately 75 degrees from oblique seams to side seams of the garment. The strips may have a width of between approximately 2 inches and 12 inches. According to another embodiment, the upper-body stabilization garment includes a front portion to contact a front upper-body region of a subject and a rear portion to contact a rear upper-body region of the subject. At least one of the front or rear portions includes an x-shaped elastomeric portion.

United States Patent Application Publication Number 2012/0179080 appears to disclose a posture-improving support garment that comprises: a main body section covering at least the upper body; and a belt-like straining section having a straining force stronger than that of the main body section, wherein the straining section extends right and left downward from at least any one of the seventh to ninth thoracic vertebrae, passes via lower portions of the right and left ribs, and joins at a center of the lower abdomen, and wherein at the center of the lower abdomen, a center line of the straining section is located between the navel and the upper end of the pubis.

United States Patent Application Publication Number 2011/0302686 appears to disclose a sports garment adapted to cover at least one limb or body member, such garment including a textile base primarily worn in close contact with the body and including a compression zone surrounding the limb/member, the compression zone including at least one film affixed to the textile base, the film including a plurality of openings. The compression zone includes at least one exclusive compression zone and at least one postural support zone, the yield strength of the garment portion forming the postural support zone being greater than that of the garment portion forming the exclusive compression zone, along at least one direction of bias.

United States Patent Application Publication Number 2009/0171259 appears to disclose a post-operative compression garment having a linear elastic section and a supportive section. The supportive section has a controlled stretch-profile with progressive elastic material properties with linear elastic material properties below an extension of 20%. The supportive section may be constructed of a layered material where the two layers have different material properties and where one of the layers is slightly oversized compared to the other layer. The garment can be constructed to fit various parts of the wearer's body and can be worn immediately after surgery to prevent hernia and/or wound rupture.

While the above-identified patents and publications do appear to disclose various embodiments of modified apparel, shapewear, and braces, their configurations remain non-desirous and/or problematic inasmuch as, among other things, none of the above-identified products use tactile cueing to remind the wearer to engage/tighten certain muscles and/or improve posture—especially in the absence of braces and/or physically restrictive apparel.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to an article of clothing adapted to be worn by a wearer, comprising, consisting essentially of, and/or consisting of: (a) a shirt body, wherein the shirt body includes an inner surface and an outer surface, wherein the shirt body includes apertures for the wearer's head, arms, and torso, and wherein the shirt body is adapted to compressively fit the wearer in a non-restrictive manner, and (b) a tactile cueing member, wherein the tactile cueing member is associated with the inner surface of the shirt body, and wherein the tactile cueing member contacts a portion of the wearer's skin during normal use.

In a preferred embodiment of the present invention, the tactile cueing member helps to improve the wearer's posture and/or core strength.

In another preferred embodiment of the present invention, the tactile cueing member reminds the wearer to engage/tighten a predetermined muscle and/or muscle region.

In yet another preferred embodiment of the present invention, the tactile cueing member reminds the wearer to engage/tighten the wearer's abdomen, scapular region, and/or lumbar region.

In one preferred embodiment of the present invention, the tactile cueing member uses touch of the wearer's skin to remind the wearer to engage/contract a muscle and/or muscle region in the absence of applying pressure, vibration, a stretch, or tension to a muscle of the wearer.

In a preferred implementation of the present invention, the shirt body is made from a combination 85% polyester and 15% spandex.

In another preferred implementation of the present invention, the shirt body is made from a combination of 80% cotton and 20% elastane.

In yet another preferred implementation of the present invention, the tactile cueing member comprises a thermoplastic elastomer. In this embodiment, the thermoplastic elastomer is preferably selected from the group consisting of a styrenic block copolymer, a thermoplastic olefin, an elastomeric alloy, a thermoplastic polyurethane, a thermoplastic copolyester, a thermoplastic polyamide, and combinations thereof.

In one preferred implementation of the present invention, comprises an elastomer. In this embodiment, the elastomer is preferably selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof. The tactile cueing member may also comprise latex.

In a preferred embodiment of the present invention, the shirt body is associated with an anti-microbial agent and/or an anti-fungal agent.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
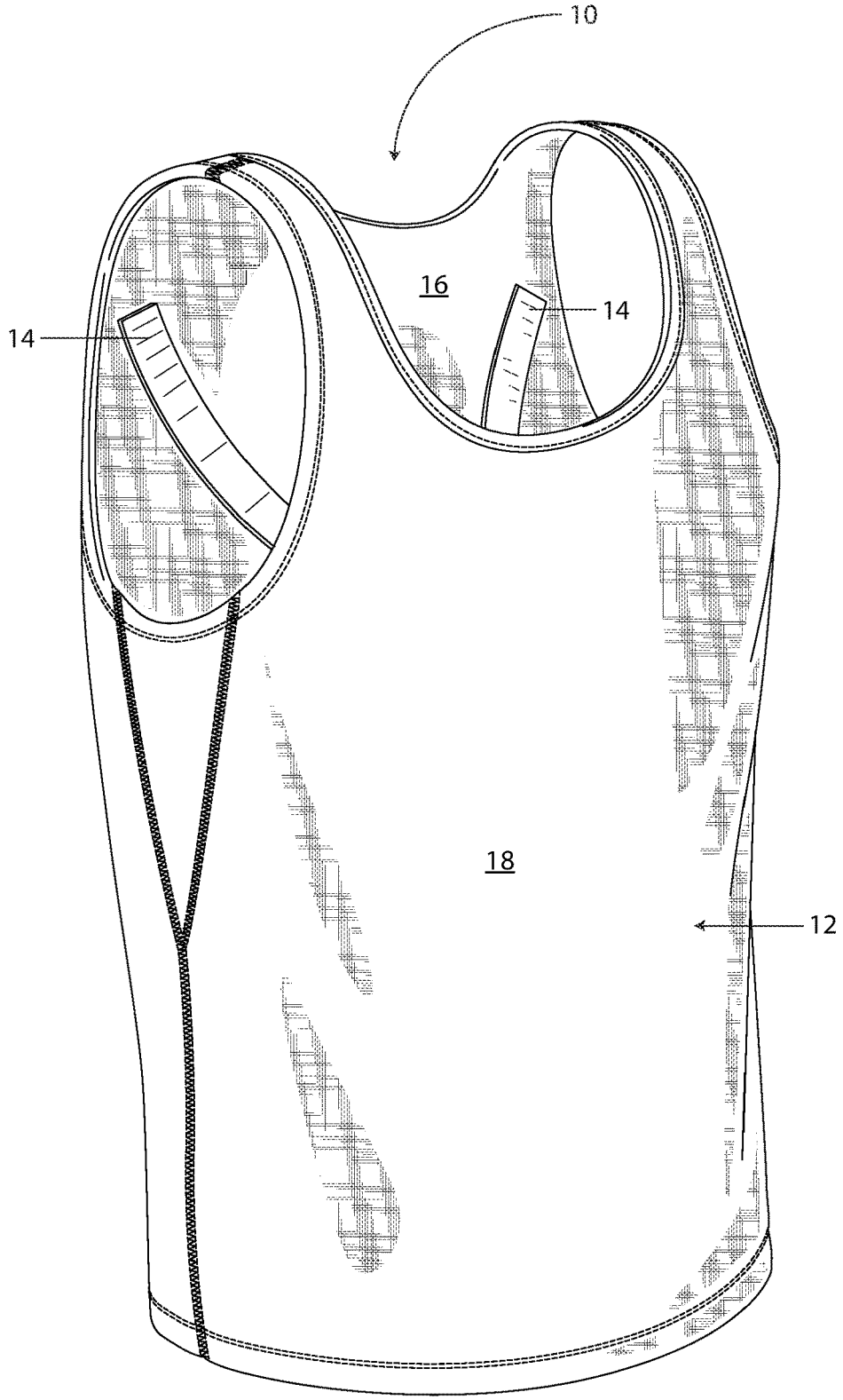
Figure 2:
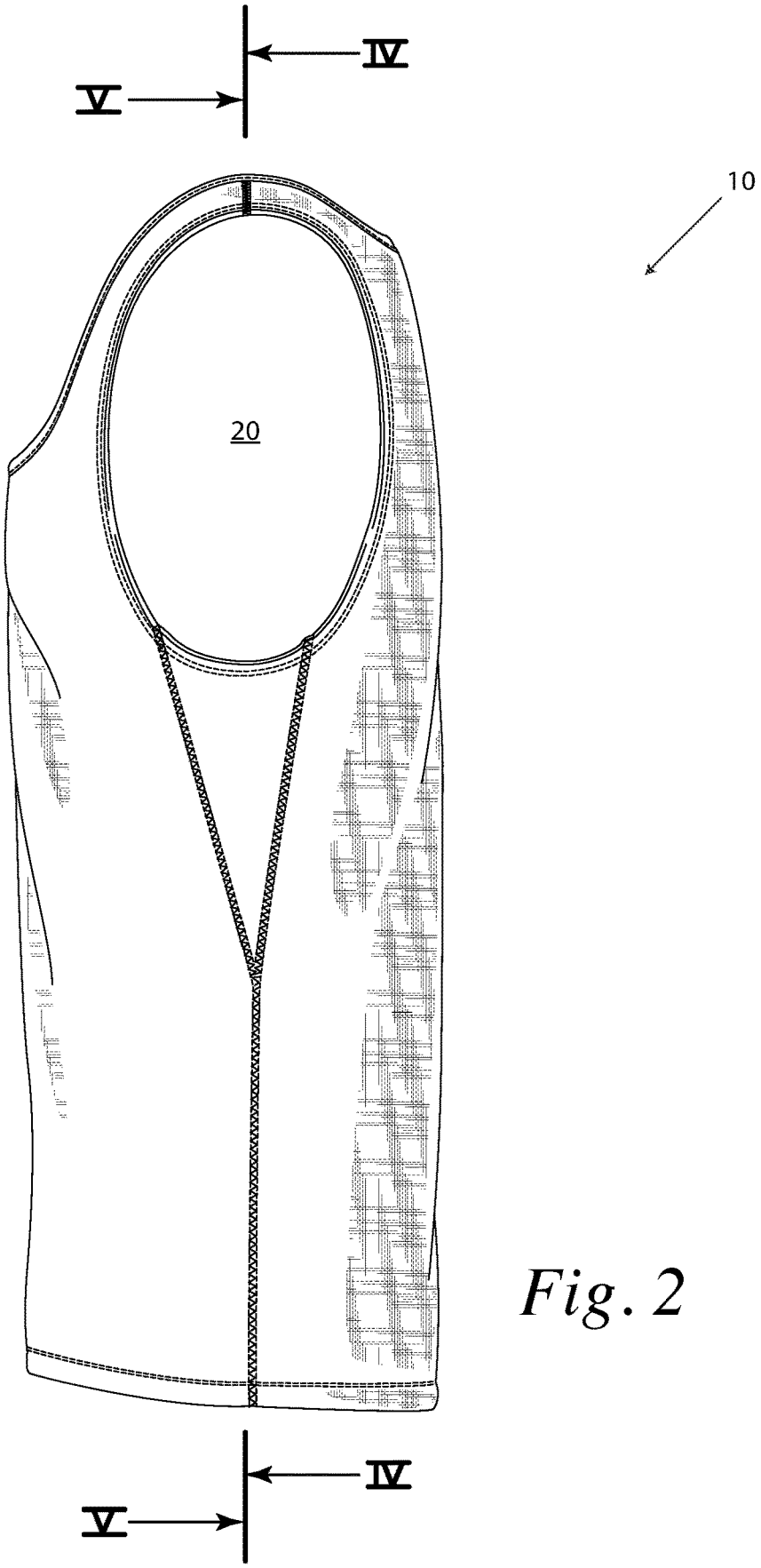
Figure 3:
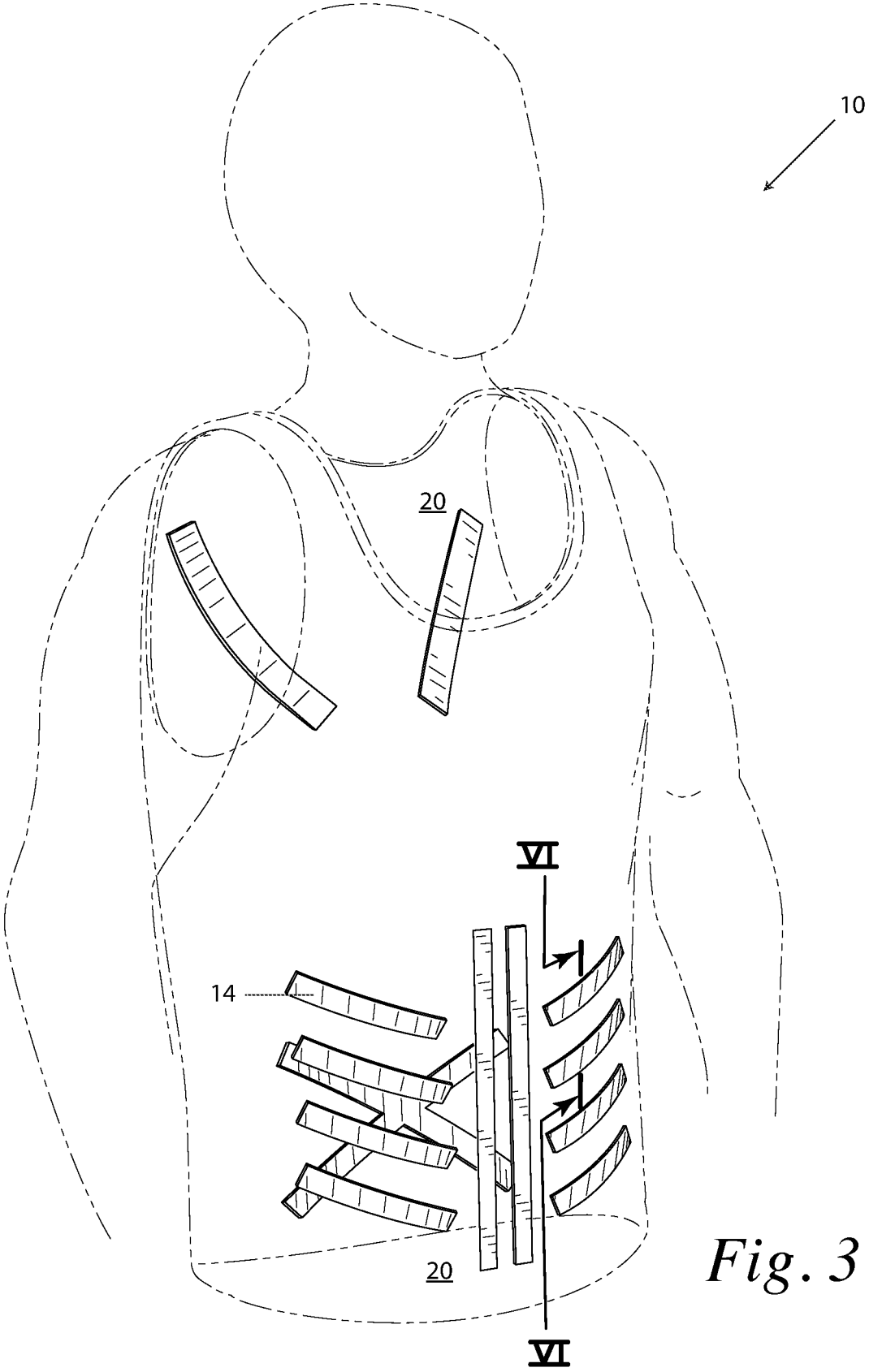
Figure 4:
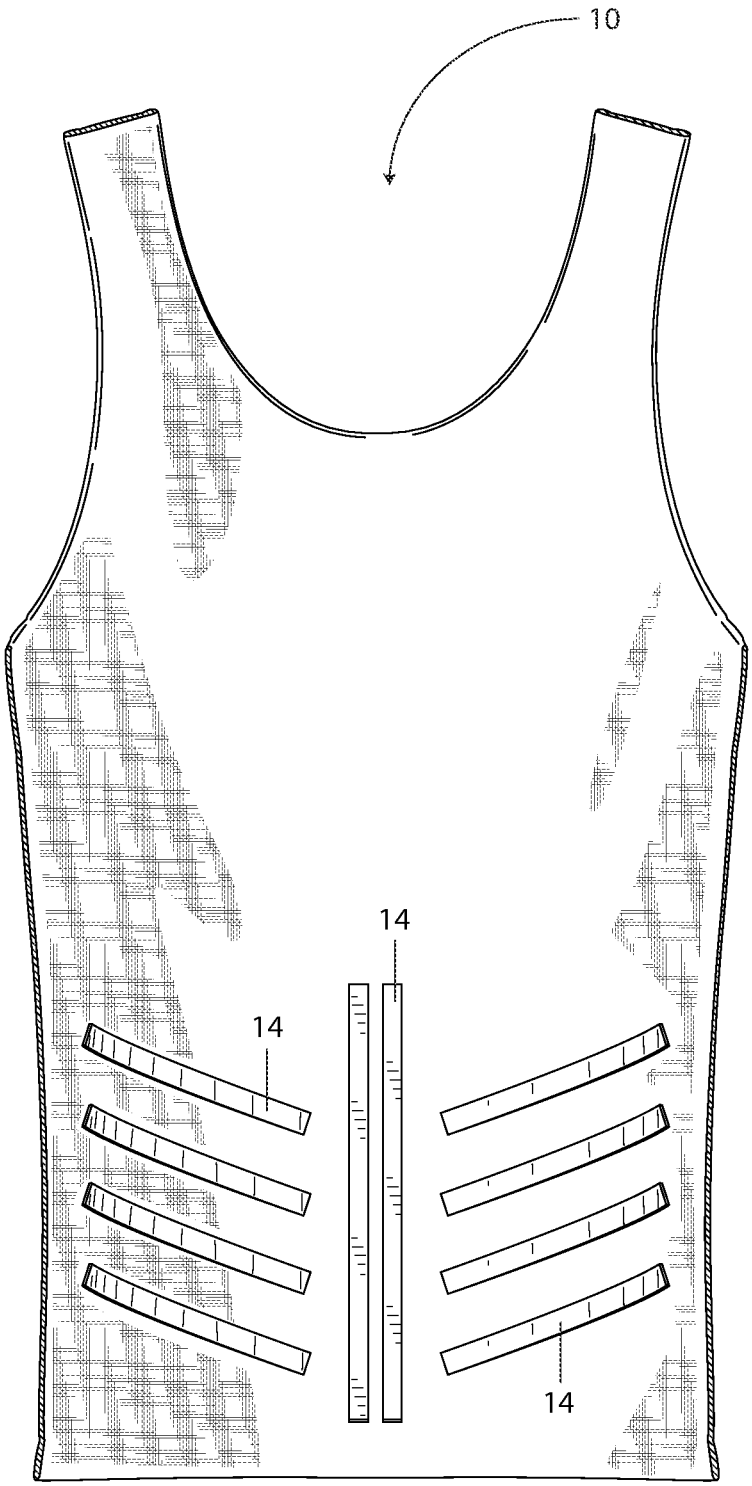
Figure 5:
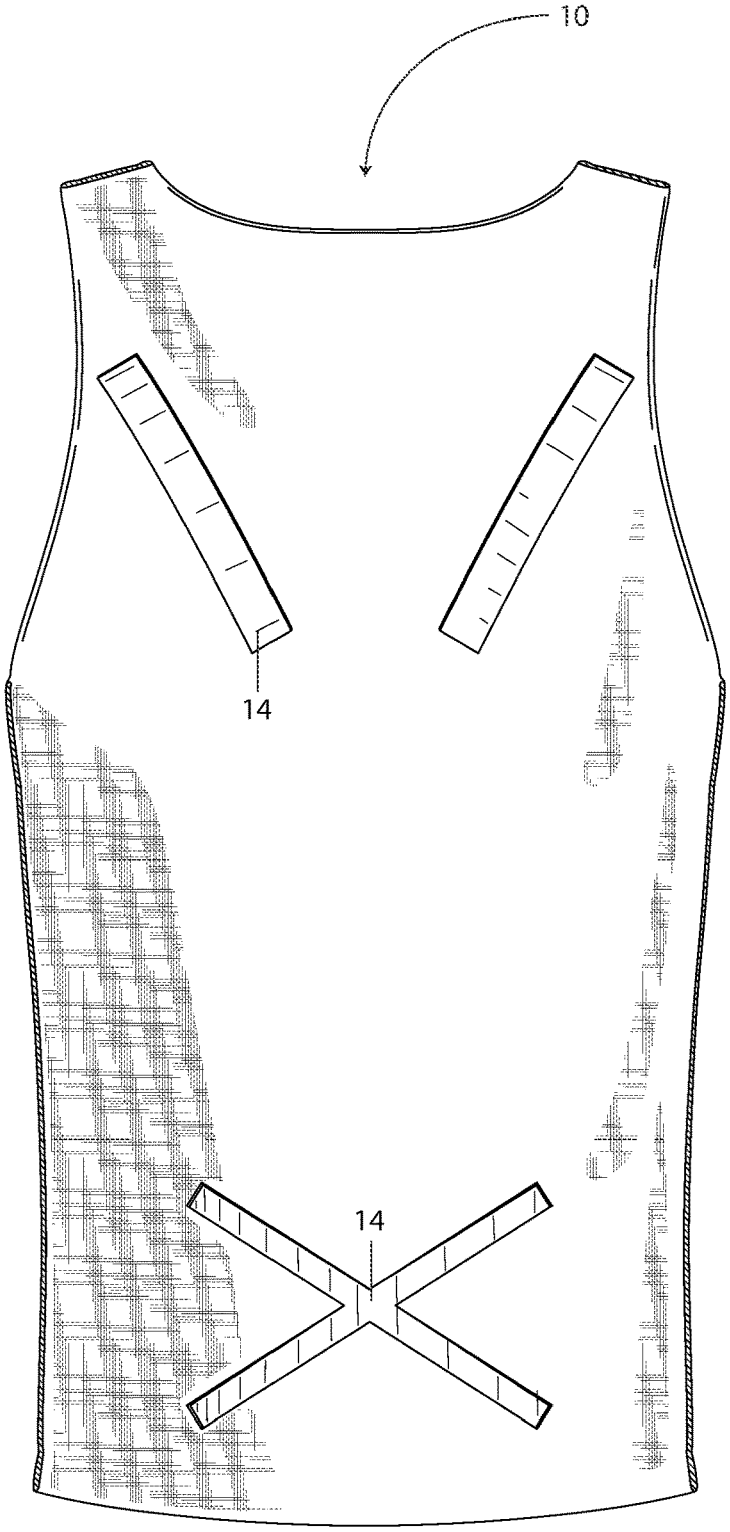
Figure 6:
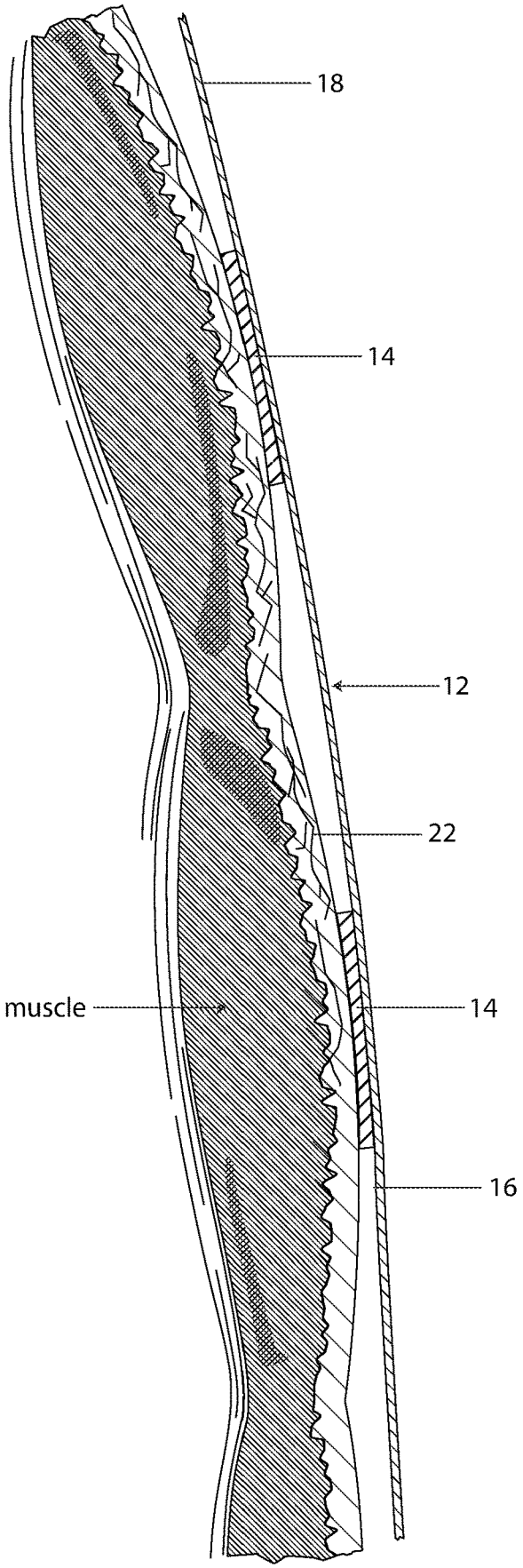
Figure 8:
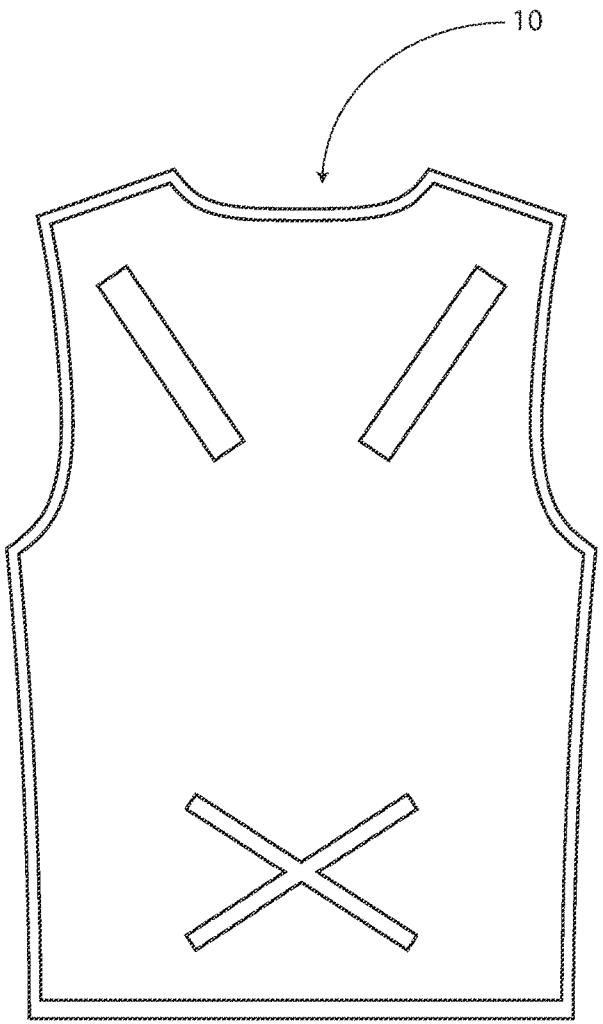
Figure 7:
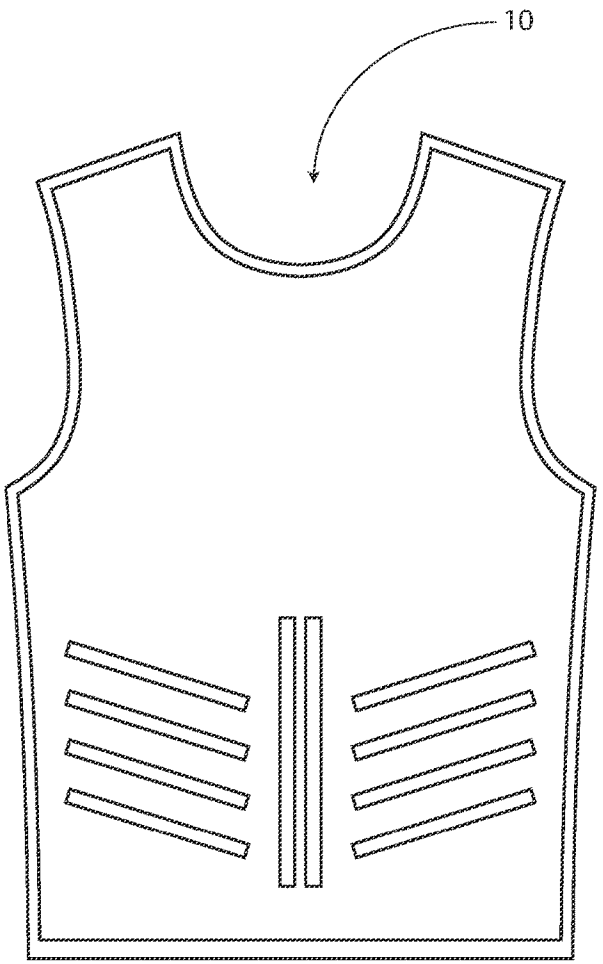
Figure 10:
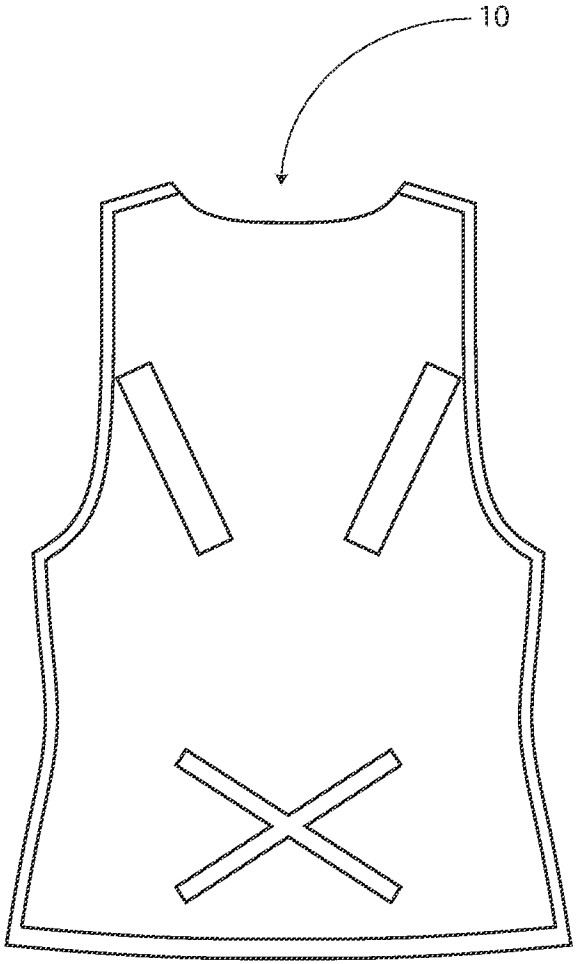
Figure 9:
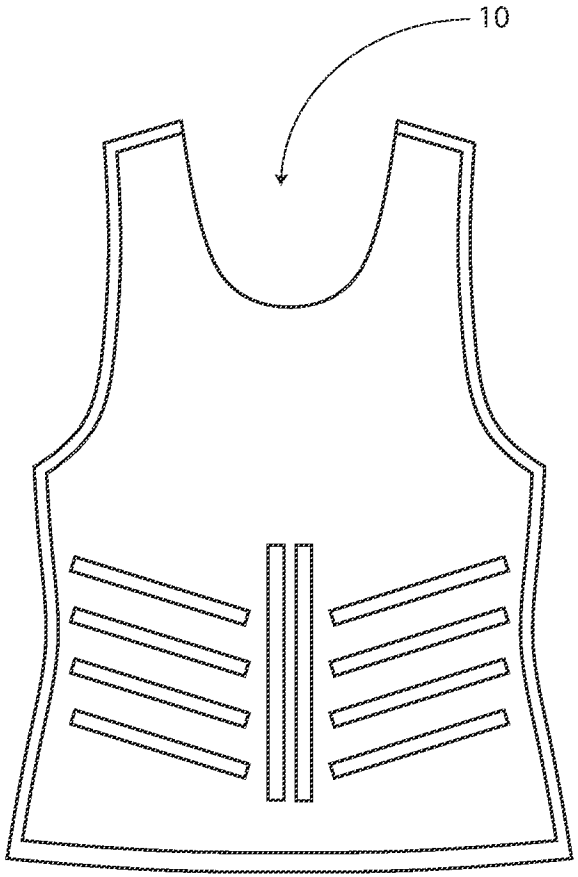

The invention will now be described with reference to the drawings wherein:

FIG. 1 is a front perspective view of active enhancement apparel of the present invention;

FIG. 2 is a left side view of the apparel of FIG. 1. The right side view is a mirror image of the left side view;

FIG. 3 is a front perspective view of the apparel of FIG. 1, a portion of which is shown in phantom depicting the environment of the apparel (e.g., adorned by a human);

FIG. 4 is a cross-sectional view of the apparel taken along line IV of FIG. 2;

FIG. 5 is a cross-sectional view of the apparel taken along line V of FIG. 2;

FIG. 6 is a cross-sectional view of the apparel taken along line VI of FIG. 3;

FIG. 7 is a two-dimensional schematic diagram of a first embodiment of the present invention, showing tactile cueing members associated with the front of the apparel;

FIG. 8 is a two-dimensional schematic diagram of a first embodiment of the present invention, showing tactile cueing members associated with the back of the apparel;

FIG. 9 is a two-dimensional schematic diagram of a second embodiment of the present invention, showing tactile cueing members associated with the front of the apparel; and FIG. 10 is a two-dimensional schematic diagram of a second embodiment of the present invention, showing tactile cueing members associated with the back of the apparel.

DETAILED DESCRIPTION OF THE INVENTION

While this invention is susceptible of embodiment in many different forms and applications, there are shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-6 in particular, a first embodiment of article of clothing 10 adapted to be worn by a wearer (e.g., a human) is shown as generally comprising shirt body 12 and one or more tactile cueing member(s) 14.

Shirt body 12 includes inner surface 16, outer surface 18, and apertures 20 for the wearer's head, arms, and torso. Shirt body 12 is adapted to compressively fit the wearer in a non-restrictive manner. In one embodiment, the shirt body is made from a combination of 85% polyester and 15% spandex. In another embodiment, the shirt body is made from a combination of 80% cotton and 20% elastane. These configurations enable shirt body 12 to compressively fit the wearer in a non-restrictive manner, such that it is non-shape wear and/or a brace that restricts range of motion of the wearer.

One or more (e.g., 1, 2, 3, 4, 5, 6, 7, 8, 9, 10, 11, 12, 13, 14, 15, 16, 17, 18, 19, 20, 25, 30, 40, 50, 75, 100, etcetera) tactile cueing members 14 are associated with inner surface 16 of shirt body 12. As is best shown in FIG. 6, tactile cueing members 14 contact a portion of wearer's skin 22 during normal use. The tactile cueing members help to improve the wearer's posture and/or the wearer's core strength. In one embodiment, the tactile cueing members remind the wearer to engage/tighten a predetermined muscle and/or muscle region. Such as, but not limited to, the wearer's abdomen, scapular region, and/or lumbar region. Preferably, the tactile cueing members use touch of/to the wearer's skin to remind the wearer to engage/contract a muscle and/or muscle region in the absence of applying pressure, vibration, a stretch, or tension to a muscle of the wearer. Preferred configurations for tactile cueing members 14 are schematically shown in FIGS. 7-10. Tactile cueing members 14 can self-adhere, be glued, stitched and/or otherwise secured to shirt body 12. In one embodiment, tactile cueing members 14 are elastic and impregnated into, onto and/or form part of the material of shirt body 12.

In a preferred embodiment of the present invention, tactile cueing member(s) 14 comprises a thermoplastic elastomer. In this embodiment, the thermoplastic elastomer is selected from the group consisting of a styrenic block copolymer, a thermoplastic olefin, an elastomeric alloy, a thermoplastic polyurethane, a thermoplastic copolyester, a thermoplastic polyamide, and combinations thereof.

In another preferred embodiment of the present invention, tactile cueing member(s) 14 comprises an elastomer. In this embodiment, the elastomer is selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, latex, and combinations thereof.

In accordance with the present invention, shirt body 12 and/or tactile cueing member(s) 14 is optionally associated with an anti-microbial agent and/or an anti-fungal agent. Suitable examples include those disclosed in United States Patent Application Publication Number 2019/0142087 entitled "Friction Enhancing Athletic Apparel"—which is hereby incorporated herein by reference in its entirety including all references cited therein.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. An article of clothing adapted to be worn by a wearer, comprising:

a shirt body fabricated from a material comprising 85% polyester and 15% spandex, wherein the shirt body includes an inner surface configured to contact the wearer's skin and an outer surface opposite to the inner surface, wherein the inner surface and the outer surface define opposing sides of the shirt body, wherein the shirt body includes apertures for the wearer's head, arms, and torso, wherein the shirt body is adapted to compressively fit the wearer, and wherein the shirt body extends from a neck region to a waist region;

exactly thirteen tactile cueing members secured to the inner surface of the shirt body, wherein the thirteen tactile cueing members are arranged in a bilateral symmetrical pattern across the inner surface, wherein each tactile cueing member comprises a thermoplastic elastomer, wherein each tactile cueing member has an inner contact surface configured to engage the wearer's skin and an outer attachment surface secured to the inner surface of the shirt body, wherein the inner contact surface and the outer attachment surface define opposing surfaces of each tactile cueing member, wherein portions of the inner surface of the shirt body positioned between adjacent tactile cueing members are configured to directly contact the wearer's skin;

wherein ten tactile cueing members are positioned on a front portion of the inner surface of the shirt body and comprise elongated rectangular elements each having a length greater than a width;

wherein three tactile cueing members are positioned on a back portion of the inner surface of the shirt body, wherein the three tactile cueing members comprise a first diagonal element, a second diagonal element, and an X-shaped element positioned below the first and second diagonal elements; and wherein each of the thirteen tactile cueing members is positioned entirely between the neck region and the waist region of the shirt body.

* * * * *